US005928055A

United States Patent [19]

Gramsch

[11] Patent Number: 5,928,055

[45] Date of Patent: Jul. 27, 1999

[54] SOMERSAULTING TOY FIGURE

[76] Inventor: Hans Heinrich Gramsch, Bahnhofstrasse 26, D-72138 Kirchentellinsfurt, Germany

[21] Appl. No.: 09/021,346

[22] Filed: Feb. 10, 1998

[30] Foreign Application Priority Data

Dec. 4, 1997 [DE] Germany ..... 197 53 708

[51] Int. Cl.[6] ..... A63H 15/08; A63H 11/08; A63H 3/28

[52] U.S. Cl. ..... 446/324; 446/297; 446/309; 446/419

[58] Field of Search ..... 446/167–169, 446/173, 297, 298, 308, 309, 324, 351, 397, 418, 419

[56] References Cited

U.S. PATENT DOCUMENTS

| | | | |
|---|---|---|---|
| 1,272,588 | 4/1918 | White | 446/324 |
| 2,532,116 | 11/1950 | Monaco | 446/419 |
| 2,751,707 | 6/1956 | Kask | 446/324 |
| 4,863,169 | 9/1989 | Miyazaki | 446/168 |
| 5,575,702 | 11/1996 | Silvious | 446/431 |
| 5,653,171 | 8/1997 | LeBron et al. | 104/60 |

FOREIGN PATENT DOCUMENTS 1678387 10/1971 Germany .

*Primary Examiner*—Robert A. Hafer
*Assistant Examiner*—Laura Fossum
*Attorney, Agent, or Firm*—Pendorf & Cutliff

[57] ABSTRACT

In conclusion the following is to be remembered: The invention concerns a somersault toy figure with a guide-way 12 provided within a figure shell 10 and a roller body 14 moveable back and forth within the guide-way between two end positions separated from each other for bringing about a somersault movement upon placement upon an inclined plane. For achievement of a additional acoustic effect there is provided a oscillating body formed as a tubular section 16, which by the movement of the roller body 14 is mechanically brought to acoustically oscillating.

13 Claims, 1 Drawing Sheet

SOMERSAULTING TOY FIGURE

BACKGROUND OF THE INVENTION

1. Field of the Invention

The invention concerns a somersaulting toy figure with a guide-way provided within the shell of the figure, and with a roller body moveable back and forth in the guide-way between two spaced-apart end-stops for producing a somersault movement of the figure shell.

2. Description of the Related Art

Toy figures of this type can be placed upon a sloping surface such that the guide-way is inclined, whereupon the roller body under the influence of gravity bumps against the end-stops of the guide-way and thereby causes a somersault like flipping over of the figure shell and the therewith fixedly associated guide-way. The somersault movement occurs about an axis perpendicular to the movement direction of the guide-way. The roller body after the flipping over is thus found again in the higher end-stop, so that the flipping over or somersault movement occurs in a repeated sequence in the absence of other external influences.

SUMMARY OF THE INVENTION

Beginning therewith the invention is concerned with the task of providing a toy figure of the above-described type in such a manner, that besides the somersault movement an additional effect occurs which engages the attention of the person playing with the toy figure.

In the invention is based upon the idea of combining the roller body with a sound source for production of sound or noise. In order to achieve this, there is proposed in accordance with the invention a vibrating body, which is mechanically brought into vibration by the movement of the roller body. Therewith there can in a simple manner be provided a surprising acoustical effect which is coupled with the occurrence of the somersault movement.

In a particularly preferred construction the vibrating body is constructed as a roller body receiving, longitudinally extending hollow body, which serves at the same time as the guide-way. For achievement of noise, the hollow body can exhibit a plurality of internally protruding rubbing organs which come into contact with the roller body during the movement thereof.

Preferably the vibrating body is formed by a tubular segment which is circular in cross-section and which receives the ball shaped roller body. With respect thereto, in consideration of the method of operation, noises can be achieved in a simple manner when the tubular section is formed as a segment or piece of corrugated tubing. The wave shaped tube constrictions thereby serve at the same time as rubbing organs for achievement of the sound vibrations, wherein as a result of the movement of the roller body a short raw sound is produced. A further improvement, mainly with respect to the manufacturing technique, can be achieved thereby that the tubular piece is comprised of a plastic tubular extrusion cut to size.

An advantageous embodiment both with respect to the movement sequence as well also the achievement of sounds presupposes that the roller body is made of a heavy material such as massive ball comprising metal or glass. The figure shell should in comparison therewith be as light as possible and can in advantageous manner be formed of a flexible shell or jacketing material which encompasses the tubular segment in a non-sliding manner, preferably made of a textile material. The figure shell can, by securing in position at the end stops of the vibrating body, simultaneously be employed to close off the tubular segment at its ends, whereby a convex curvature in this area facilitates the flipping over of the toy figure during the rolling-down movement.

According to a further preferred embodiment of the invention the figure shell is provided in the form of a frog. Therewith, in particular by the utilization of a corrugated tubular segment, as a result of the therewith produced frog-croaking-like vibration noise, there is achieved a peculiar and characteristic effect.

BRIEF DESCRIPTION OF THE DRAWINGS

In the following the invention will be described in greater detail by reference to the embodiment represented in the drawings in schematic manner. There is shown FIG. 1 a somersault toy figure in horizontal section.

DETAILED DESCRIPTION OF THE INVENTION

Figure 1:
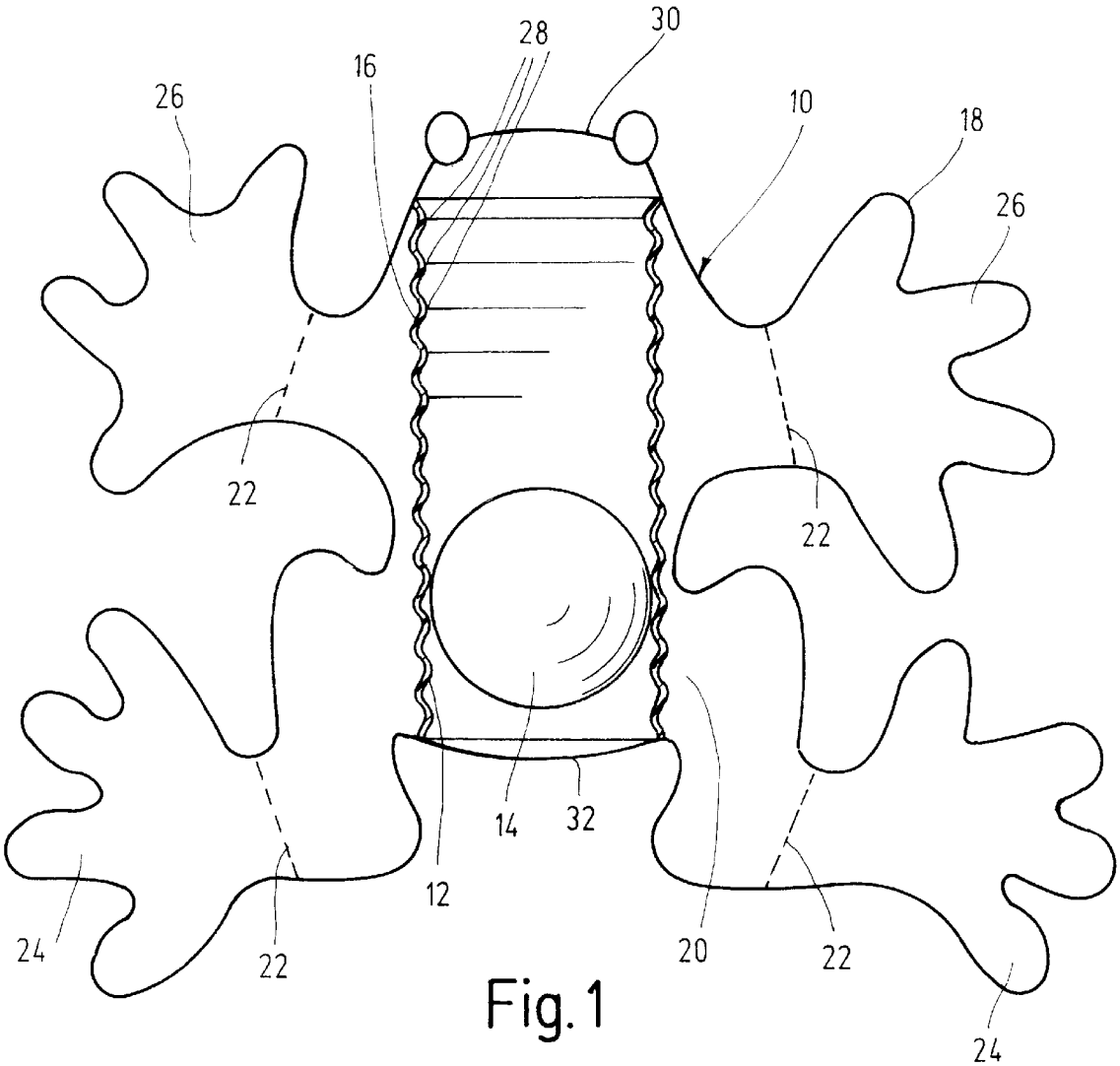
Figure 2:
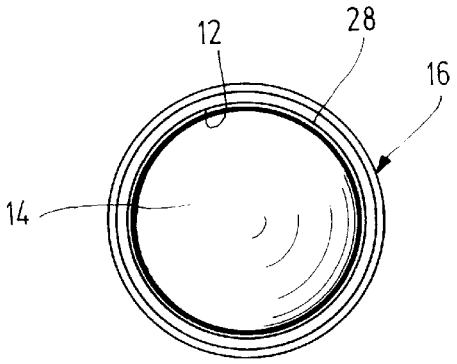
FIG. 2 an end view of a ball-shaped roller-body guiding tube segment of the toy figure according to FIG. 1.

The somersault toy figure represented in the drawings is comprised essentially of a figure shell 10, a guide-way 12 securely enclosed within the figure shell and a roller body 14 moveable back and forth within the guide-way 12 for achievement of a somersault movement of the figure shell 10 or, more specifically, toy figure, wherein the guide-way 12 hollow body is an oscillating body 16 capable of being made to vibrate.

The figure shell 10 is comprised of a flexible shell material 18 of a textile material and has the shape of a frog. Within the figure shell 10 there is a lengthwise extending hollow chamber 20 tailored for receiving the oscillating body 16 and separated by threads 22 from the peripheral, sideways flat extending shell sections 24, 26.

The oscillating body 16 is formed by a cross-sectionally circular, thin walled corrugated tubular section, which is formed of a suitable cut-off tubular extrusion profile of plastic. The tubular section 16 exhibits therewith in its axial direction a corrugated shaped inner contour, wherein the thinner cross-section protruding sections or, as the case may be, projections 28, together with the roller body 14 during the movement thereof form a rubbing or rasping organ serving for production of sound.

The roller body 14 is constructed as a massive, heavy metal ball, of which the diameter is slightly less than the thinner cross-section of the projections 28. The ball 14 is thus axially moveably guided within the inside of the tubular section 16, wherein the outwardly curved, in certain cases strengthened by inserts, shell cloth or material sections 30, 32 close off the end sections of the tubular segment 16 and therewith determine the terminus of the guide path.

For achievement of a somersault movement the toy figure can be placed upon a slanted plane, so that the tubular segment 16 is inclined downwards and the ball 14 rolls under gravity against the end-stop. In the end position there is then accomplished, by impulse conversion, a somersault or, as the case may be, flipping over movement of the toy figure, whereupon the shell material pieces 30, 32, on the basis of their outward curvature, facilitate the flipping over. The ball 14 rolls anew in the resting tubular section 16 to the lower lying end position, so that overall a discontinuous effective movement process of the toy figure is achieved.

As a further effect which is surprising for those playing with the toy, there is produced by the rapid movement by the ball 14 between the end positions by repeated impacting or, as the case may be, rubbing at the thinner cross-section 28 of the tubular piece 16, a vibrating sound which reminds one of a frog croaking. This sound is particularly effective when in combination with the frog design of the toy figure.

In conclusion the following is to be concluded: The invention concerns a somersault toy figure with a guide-way 12 provided within a figure shell 10 and a roller body 14 moveable back and forth within the guide-way between two end positions separated from each other for bringing about a somersault movement upon placement upon an inclined plane. For achievement of an additional acoustic effect there is provided an oscillating body formed as a tubular section 16, which by the movement of the roller body 14 is mechanically brought to acoustically vibrate.

What is claimed is:

1. A somersaulting toy figure including:

a figure shell;

a guideway provided within the figure shell, the guideway including two closed ends opposing each other;

a roller body moveable back and forth within the guideway between the two ends causing an end to end somersaulting movement of the figure shell when the toy figure is placed on an inclined surface; and wherein said guideway is defined by a generally cylindrical uniform oscillating body having an oscillating surface configured to cause acoustic vibration when the roller body is moved back and forth within the guideway.

2. The toy figure according to claim 1, wherein the oscillating body is constructed as a longitudinally extending hollow body.

3. The toy figure according to claim 2, wherein the hollow body includes a number of inwardly projecting rubbing organs which come into contact with the roller body by the movement thereof for inducing the acoustic vibration.

4. The toy figure according to claim 1, wherein the oscillating body is constructed as a cross-sectionally circular tubular section.

5. The toy figure according to claim 4, wherein the tubular section is formed as a corrugated tubular section.

6. The toy figure according to claim 4, wherein the tubular section comprises a section of a tubular extrusion plastic.

7. The toy figure according to claim 1, wherein the roller body is a ball.

8. The toy figure according to claim 7, wherein said ball is made of metal or glass.

9. The toy figure according to claim 1, wherein the figure shell is formed of a flexible shell material which encompasses the oscillating body, the body being fixed within the shell such that no sliding occurs.

10. The toy figure according to claim 9, wherein said flexible shell material is a textile material.

11. The toy figure according to claim 9, wherein the figure shell encloses the tubular section and fixes the ends such that the roller body is limited between said ends.

12. The toy figure of claim 11, wherein the figure shell defines the ends to be curved outwardly beyond the tubular section, and wherein said ends define limits between which the roller body can move.

13. The toy figure according to claim 1, wherein said figure shell is in the form of a frog.

* * * * *